US009629440B2

(12) United States Patent
Andrews et al.

(10) Patent No.: US 9,629,440 B2
(45) Date of Patent: Apr. 25, 2017

(54) SLEEVED STYLING CAPE

(71) Applicant: Julia Andrews, Nashville, IN (US)

(72) Inventors: Julia Andrews, Nashville, IN (US); Leada Rae Carr, Nashville, IN (US)

(73) Assignee: Julia Andrews Van Overmeiren, Indianapolis, IN (US)

( * ) Notice: Subject to any disclaimer, the term of this patent is extended or adjusted under 35 U.S.C. 154(b) by 157 days.

(21) Appl. No.: 14/470,109

(22) Filed: Aug. 27, 2014

(65) Prior Publication Data

US 2015/0059046 A1 Mar. 5, 2015

Related U.S. Application Data

(60) Provisional application No. 61/870,905, filed on Aug. 28, 2013.

(51) Int. Cl.
*A45D 44/08* (2006.01)

(52) U.S. Cl.
CPC ..... *A45D 44/08* (2013.01)

(58) Field of Classification Search
CPC .... A45D 44/08; A41D 13/04; A41D 13/0512; A41B 13/10
See application file for complete search history.

(56) References Cited

U.S. PATENT DOCUMENTS

| | | | | |
|---|---|---|---|---|
| 1,003,489 | A * | 9/1911 | Moritz | A45D 44/08 2/50 |
| 6,408,439 | B1 * | 6/2002 | Garforth-Crippen | A41B 13/106 2/80 |
| 7,996,918 | B2 | 8/2011 | Bish | |
| D686,802 | S * | 7/2013 | Washington | D2/861 |
| 2001/0039673 | A1 | 11/2001 | Carraway | |
| 2002/0138892 | A1 * | 10/2002 | Drake | A41D 13/04 2/51 |
| 2004/0199973 | A1 | 10/2004 | Moyal et al. | |
| 2008/0092263 | A1 * | 4/2008 | Good | A41D 13/04 2/49.1 |
| 2016/0029773 | A1 * | 2/2016 | Galik | A41D 13/04 2/50 |

FOREIGN PATENT DOCUMENTS

| | | | |
|---|---|---|---|
| FR | 2673515 | * 9/1992 | A45D 44/08 |
| WO | 2009143612 | 12/2009 | |

* cited by examiner

*Primary Examiner* — Shaun R Hurley
*Assistant Examiner* — Andrew W Sutton
(74) *Attorney, Agent, or Firm* — Mattingly, Burke, Cohen & Biederman

(57) ABSTRACT

A styling cape includes a flexible sheet with outer and inner surfaces, and a plurality of peripheral edges. The styling cape further includes a closure for closing a slit to secure the styling cape about an individual. First and second through-holes are formed in the flexible sheet, and positioned so as to form a triangular pattern in combination with an opening in the flexible sheet that is positioned about an individual's neck, in each of a spread-out configuration and a use configuration of the styling cape. A first sleeve and a second sleeve are attached to the sheet so as to communicate with the first and second through-hole, respectively, and form conduits with the first and second through-holes for passage of the individual's hands through the styling cape.

10 Claims, 5 Drawing Sheets

SLEEVED STYLING CAPE

PRIORITY

The present application claims priority to U.S. Provisional Patent Application No. 61/870,905, filed Aug. 28, 2013.

TECHNICAL FIELD

The present disclosure is related generally to a styling cape as used in salons, barbershops and the like, and more particularly to a styling cape with sleeves for the hands.

BACKGROUND

Hair styling capes have been used for many years, for the purpose of preventing hair falling onto an individual during styling or other hair cutting and grooming activities, and to prevent hair styling products such as dyes, straightening and curling treatment solutions, water, shampoo, conditioners, and the like, from contacting the individual's skin or clothes.

One shortcoming in conventional styling capes is that they do not allow hand access through the cape, or at least not in a convenient manner. To use his or her hands, an individual receiving a styling treatment will typically bring their arms at least partially outside of the cape, exposing their skin and clothing to the salon elements. Damage to skin and clothing is a risk where exposed to solutions that can contain caustic or staining components, as well as cut hair itself which, while harmless, is generally unsightly and undesired to carry around on one's clothes.

SUMMARY

In one aspect, a styling cape includes a flexible sheet having an outer surface and an inner surface, and a plurality of outer peripheral edges. The outer peripheral edges include a front edge, a back edge opposite the front edge, and a first and a second side edge extending between the front and back edges so as to form a substantially rectangular shape when the flexible sheet is flat and unfolded in a spread-out configuration of the styling cape. The back edge is bisected by a slit extending from the back edge to a curved inner peripheral edge forming an opening for positioning about an individual's neck when the flexible sheet is draped over the individual in a use configuration of the styling cape. The styling cape further includes a closure having a first closure element and a second closure element positioned upon opposite sides of the slit, respectively, for closing the slit to secure the styling cape about the individual in the use configuration. The styling cape further has a first through-hole and a second through-hole formed in the flexible sheet, and positioned so as to form a triangular pattern in combination with the opening in each of the spread-out configuration and the use configuration. The styling cape further includes a first sleeve and a second sleeve attached to the sheet so as to communicate with the first and second through-holes, respectively, and forming conduits with the first and second through-holes for passage of the individual's hands through the styling cape.

DETAILED DESCRIPTION OF ILLUSTRATIVE EMBODIMENTS

Figure 1:
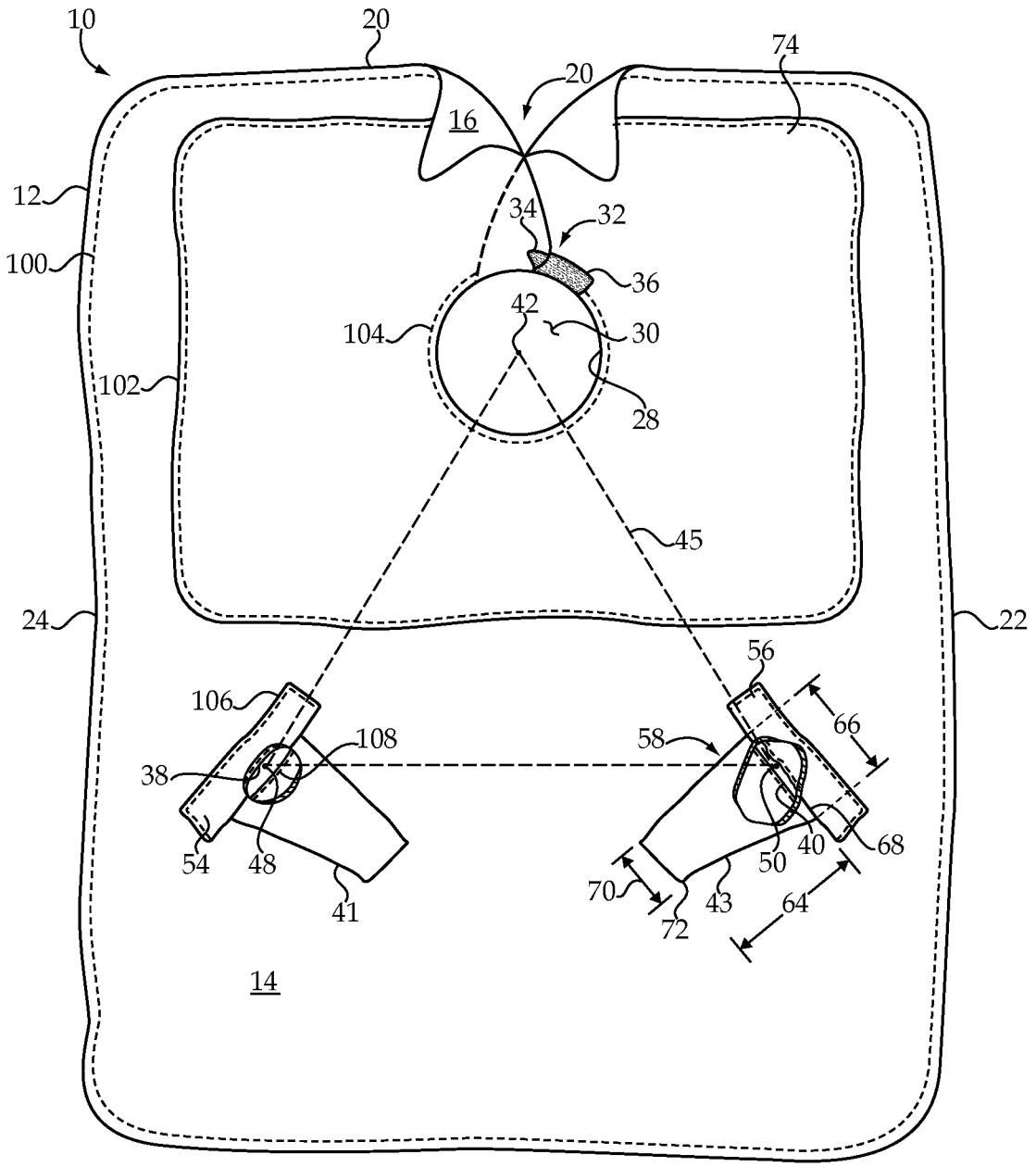
FIG. 1 is a top elevation view of a sleeved styling cape, according to one embodiment.

Referring to FIG. 1, there is shown a styling cape 10 according to one embodiment. Styling cape 10 includes a flexible sheet 12 including an outer surface 14 and an inner surface 16, and a plurality of outer peripheral edges. The outer peripheral edges include a front edge 18, a back edge 20 opposite front edge 18, and a first and a second side edge 22 and 24, respectively, extending between front edge 18 and back edge 20 so as to form a substantially rectangular shape when flexible sheet 12 is flat and unfolded in a spread-out configuration of styling cape 10. In FIG. 1, styling cape 10 is shown substantially in its flat and unfolded, spread-out configuration, apart from a portion of styling cape 10 along back edge 20, where it can be seen two corners of flexible sheet 12 are folded back to expose inner surface 16. In a practical implementation strategy, a slit 26 substantially bisects back edge 20, and extends from back edge 20 to a curved inner peripheral edge 28 forming an opening 30. Opening 30 is structured for positioning about an individual's neck when flexible sheet 12 is draped over the individual in a use configuration of styling cape 10, as further discussed herein.

Styling cape 10 further includes a closure 32 having a first closure element 34 and a second closure element 36 positioned upon opposite sides of slit 26, respectively, for closing slit 26 to secure styling cape 10 about the individual in the use configuration. In one practical implementation strategy, closure 32 includes a hook and loop style fastening system, such as Velcro®, but in other embodiments could include conventional hooks and eyes, buttons, snaps, magnets, or any other contrivance suitable for releasably attaching sheet 12 to itself to temporarily close slit 26 and to secure styling cape 10 about an individual for service. As will be further apparent from the following description, styling cape 10 is uniquely configured to allow an individual to pass his or her hands and portions of the wrists through flexible sheet 12 during use, enabling the individual to access and use a portable electronic device, a beverage, or for any other purpose.

As noted above, the general shape of flexible sheet 12 when flat and unfolded and spread-out is substantially rectangular. It can also be noted from FIG. 1 that corners of the substantially rectangular shape are rounded. In other embodiments, the corners might be relatively sharper or relatively more gently rounded or curved than that shown. Extending generally circumferentially about flexible sheet 12 just inside outer peripheral edges 18, 20, 22 and 24, is a stitch line 100 that forms a hem or the like. Those skilled in the art will thus appreciate that flexible sheet 12 can be doubled upon itself and stitched to form hems in any suitable manner, and at various locations. In a practical implementation strategy, sheet 12 is formed of suitable polymeric material, such as polyester, polyurethane, polyurethane with a backing layer or the like, or any of a variety of nylons such as oxford nylon, Antron® nylon, 100% nylon, and combinations of any of these materials. For purposes of the present description, the material of which flexible sheet 12 is constructed can be understood as a first material.

Figure 2:
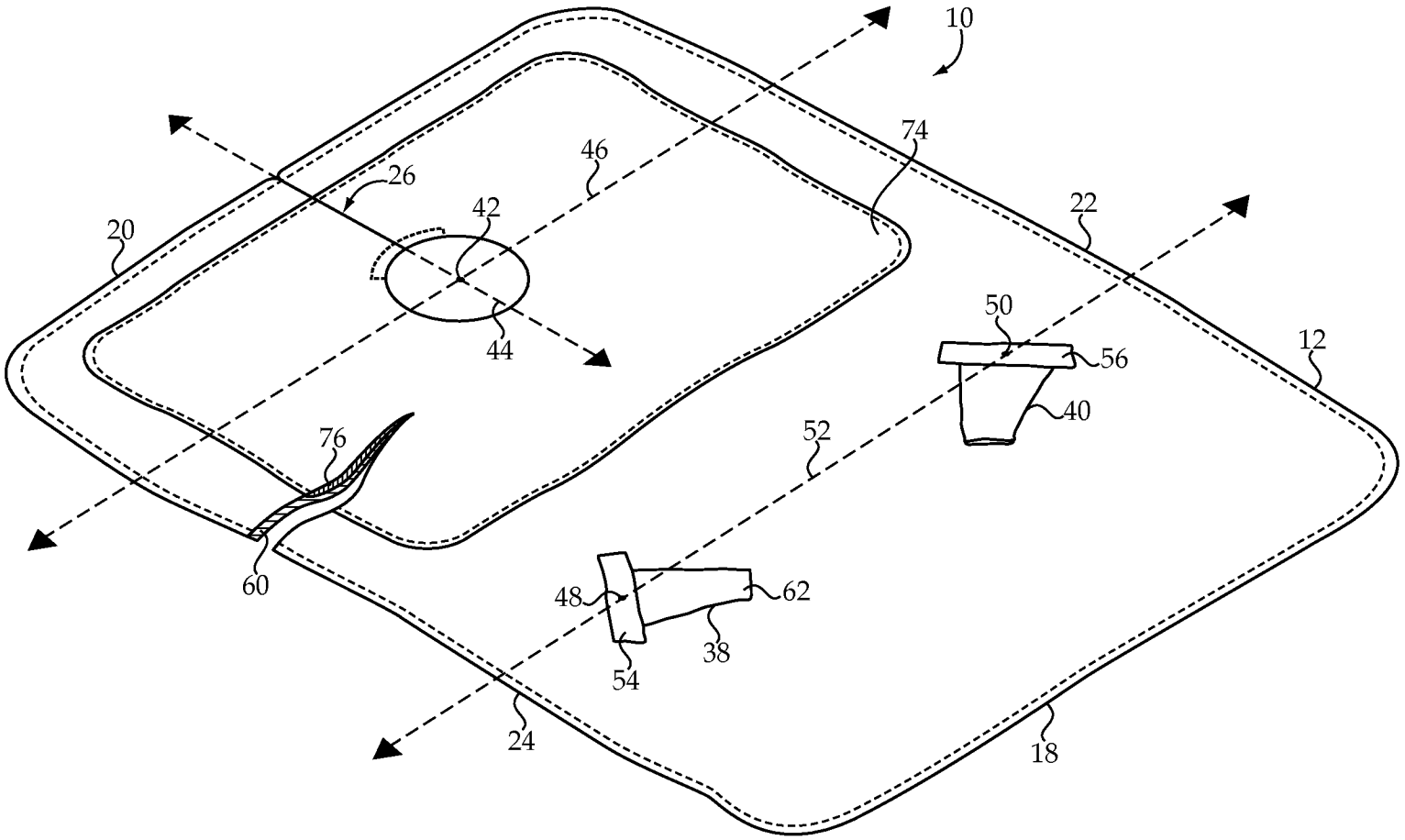
FIG. 2 is a diagrammatic view, in perspective, including a cutaway of the sleeved styling cape of FIG. 1.

As mentioned above, styling cape 10 is uniquely configured for hand access through flexible sheet 12. Referring also now to FIG. 2, illustrating a perspective view of styling cape 10, styling cape 10 further includes a first through-hole 38 and a second through-hole 40 forming flexible sheet 12, and positioned so as to form a triangular pattern in combination with opening 30. The triangular pattern is evident in each of the spread-out configuration and the use configuration as further discussed herein. In FIG. 1, a triangle 45 corresponding to the triangular pattern is illustrated, the significance of the triangular pattern being further apparent from the following description.

Styling cape 10 further includes a first sleeve 41 and a second sleeve 43 attached to flexible sheet 12 so as to communicate with first and second through-holes 38 and 40, respectively, and forming conduits with first and second through-holes 38 and 40 for passage of an individual's hands through styling cape 10. It can further be seen from FIGS. 1 and 2 that each of first and second sleeves 41 and 43 has a taper 58, shown in connection with sleeve 43, so as to narrow in an outward direction away from flexible sheet 12. It will be recalled that flexible sheet 12 is formed at least in part of a first material as discussed above. In FIG. 2, the first material is shown in a partial cutaway via reference numeral 60. Each of first and second sleeves 41 and 43 is formed of a second material 62 that is elastic in comparison to first material 60.

The second material may be or include spandex, otherwise known as elastane, or another suitable polymer or co-polymer. Natural fibers, synthetic fibers, or combinations may be used to form the second material. It can also be seen from FIGS. 1 and 2 that styling cape 10 may further have a second flexible sheet 24 attached to flexible sheet 12 and surrounding opening 30 in layered arrangement with first flexible sheet 12. Second flexible sheet 74 may be formed of a third material 76 so as to form a protective layer extending over the shoulders of an individual in the use configuration of styling cape 10. That third material could be a polyvinyl chloride (PVC) or polyester, or a combination of these and other materials. Second flexible sheet 74 may thus be attached to flexible sheet 12 via stitching 102, and also potentially via an adhesive or welding. As an alternative to multiple flexible sheets, a surface treatment or the like might be directly applied to flexible sheet 12. It can also be seen that opening 30 is closer to back edge 20 than to front edge 18, in the illustrated embodiments.

Also in the illustrated embodiment, it can be seen that opening 30 has a center point 42, and a centerline 44 of slit 26 intersects center point 42 of opening 30 in the spread-out configuration. A transverse line 46 is oriented normal to centerline 44 and intersects center point 42 and each of first and second side edges 22 and 24 in the spread-out configuration of styling cape 10. In a further practical implementation strategy, each of first and second through-holes 38 and 40, respectively, has a center point 48 and 50, respectively. Center points 48 and 50 define a second transverse line 52 oriented parallel to first transverse line 46, in the spread-out configuration, and positioned closer to front edge 18 than to back edge 20. The triangular pattern, and triangle 45, is defined by center points 42, 48 and 50 in a practical implementation strategy. The various center points described herein are to be understood as geometric center points within a usual meaning of that term. The triangular pattern, and structuring of styling cape 10 generally, enables an individual's hands to be passed through styling cape 10 in a comfortable and normal use pattern or configuration. In other words, the individual's hands can be passed forwardly through styling cape 10 in a comfortable sitting position as would be typically assumed in a barber chair or the like. This differs from the design of conventional jacket or poncho sleeves, where an individual's arms are extended through sleeves connecting to shoulder areas of the article.

Referring now to the structure and composition of sleeves 41 and 43 themselves, it will be recalled that sleeves 41 and 43 form conduits with through-holes 48 and 50. In a practical implementation strategy, through-holes 48 and 50 have the general form of slits, and sleeves 41 and 43 are generally frustoconical in shape, with the larger end of the frustoconical shape attached to sheet 12 via stitching, and in register with through-holes 38 and 40. The flexible and elastic nature of sleeves 41 and 43 of course results in a rest shape of sleeves 41 and 43 that is not necessarily frustoconical, and can be substantially flattened as shown in FIGS. 1 and 2. Sleeves 41 and 43 can be placed in the frustoconical shape without substantially elastically deforming the fibers from which they are made, however. Styling cape 10 may further include a first flap 54 adjacent first through-hole 38 and first sleeve 41, and a second flap 56 adjacent second through-hole 40 and second sleeve 41. Each of flaps 54 and 56 may be oriented so as to deflect cut hair falling under the force of gravity toward first sleeve 41 and second sleeve 43, respectively. As illustrated in the drawings, flaps 54 and 56 may be generally rectangular in shape, and attached via stitching 106 in the case of sleeve 41, and via stitching that is not numbered but is illustrated in connection with flap 56. Additional stitching 108 attaches first sleeve 41 to flexible sheet 12, and it will be appreciated that corresponding stitching attaches sleeve 43 in a like manner. It will be recalled that sleeves 41 and 43 are tapered, and narrowing taper 58 is called out in connection with sleeve 43. In a practical implementation strategy, each of sleeves 41 and 43 has a sleeve length 64, and a non-uniform sleeve diameter that varies from a greater sleeve diameter 66 at a first end 68 of the corresponding sleeve adjacent the corresponding through-hole to a lesser sleeve diameter 70 at an opposite second end 72 of the corresponding sleeve. Sleeve length 64 may be about 1 to about 3 times greater sleeve diameter sleeve 66, and from about 3 to about 4 times lesser sleeve diameter 70.

Figure 3:
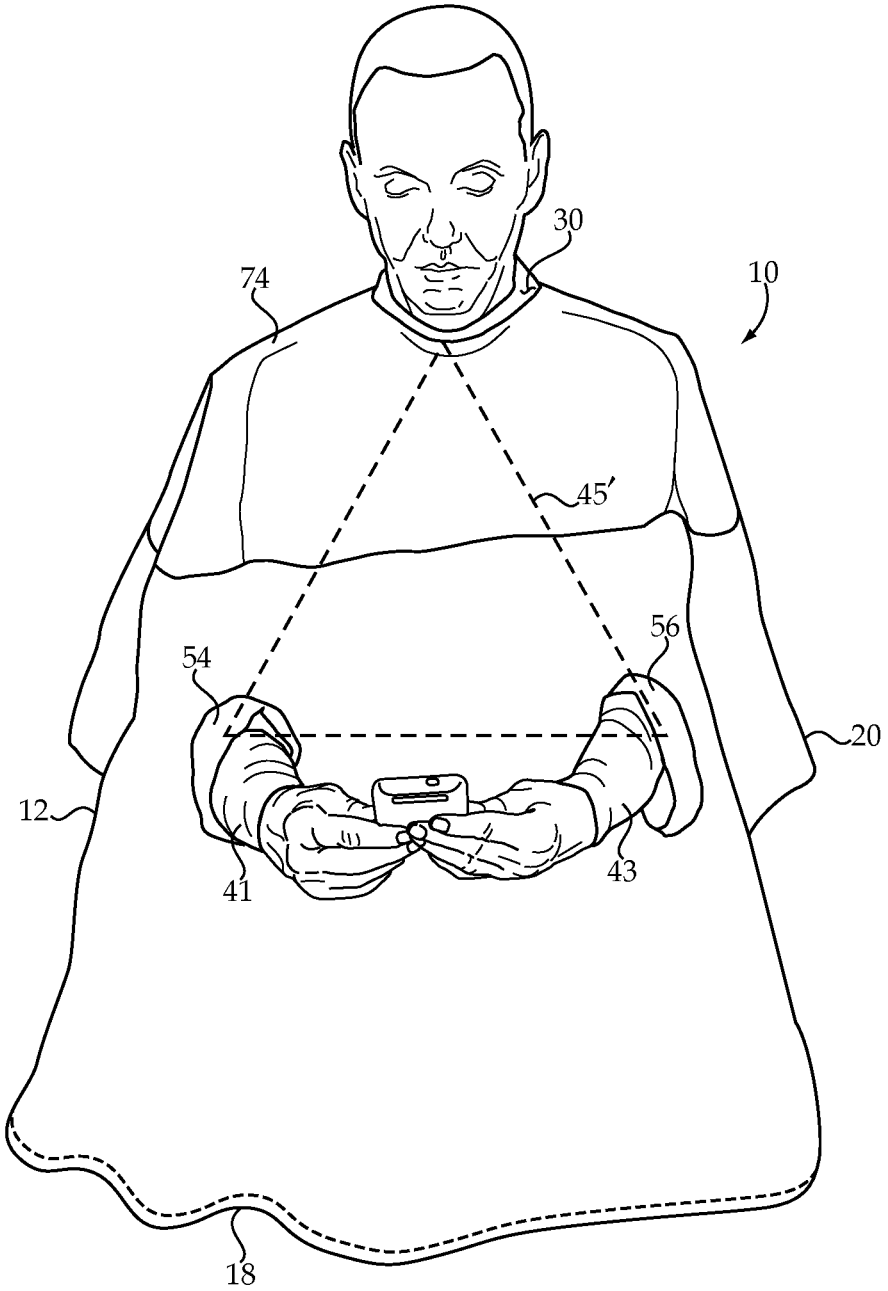
FIG. 3 is a diagrammatic view of the sleeved styling cape draped over an individual, according to one embodiment.

Referring now to FIG. 3, there is shown cape 10 draped over an individual in a use configuration. The individual can be seen to have passed his hands and portions of his wrists through sleeves 41 and 43 to enable him to comfortably and easily hold and manipulate a personal electronic device. The triangular pattern formed by through-hole 38 and 40 and opening 30 is generally different in the use configuration of FIG. 3 than in the spread-out configuration shown in FIGS. 1 and 2, but still formed and identified in FIG. 3 via reference numeral 45'. Second flexible sheet 74 can be seen in FIG. 3, and positioned generally in a manner so as to cover the shoulders of the individual. Those skilled in the art will be familiar with somewhat caustic or otherwise potentially irritating or damaging chemicals, dyes and the like used in hair styling, and thus will readily appreciate the protective function of flexible sheet 74.

Figure 4:
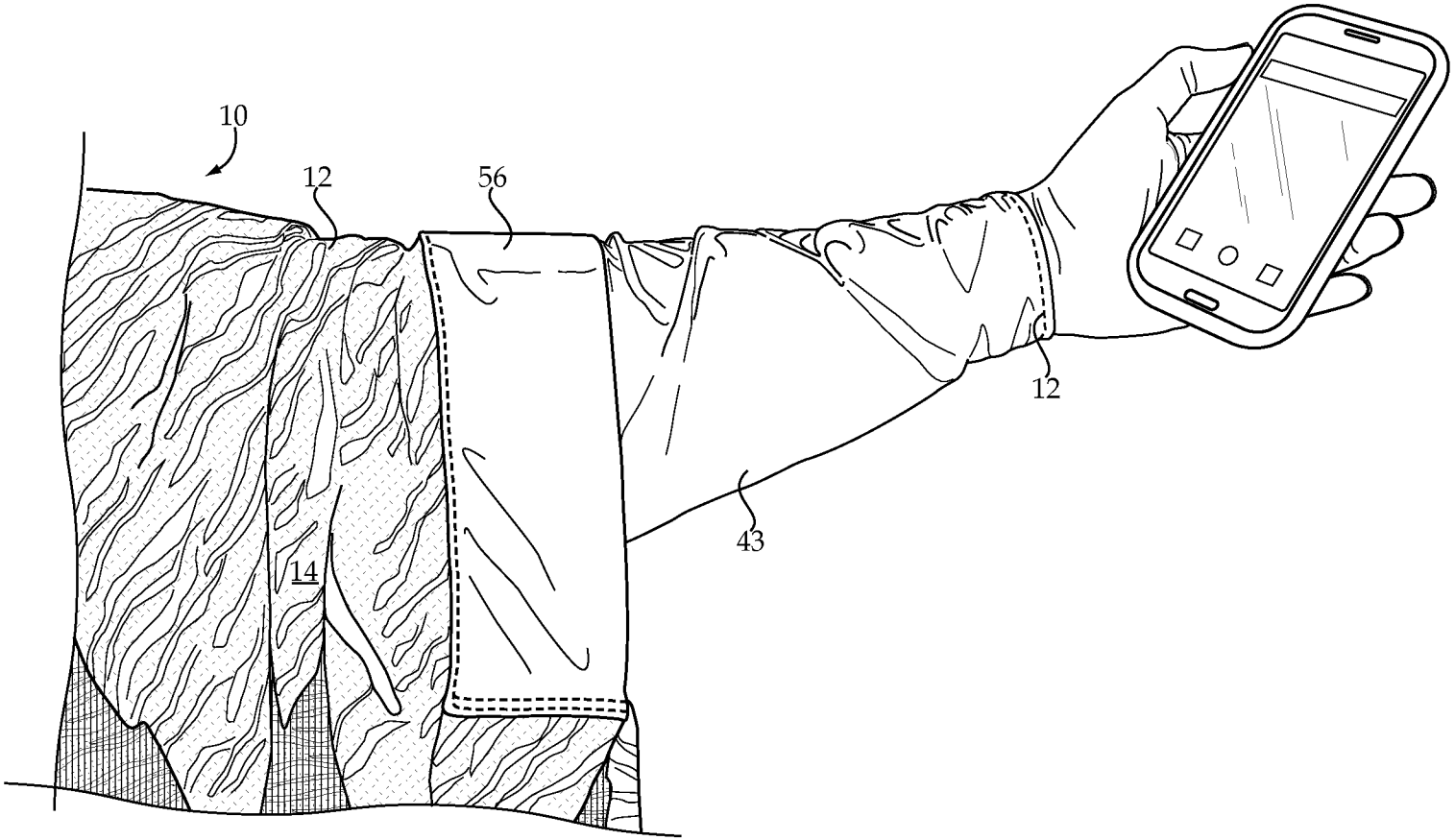
FIG. 4 is a side diagrammatic view of a portion of the sleeved styling cape.
Figure 5:
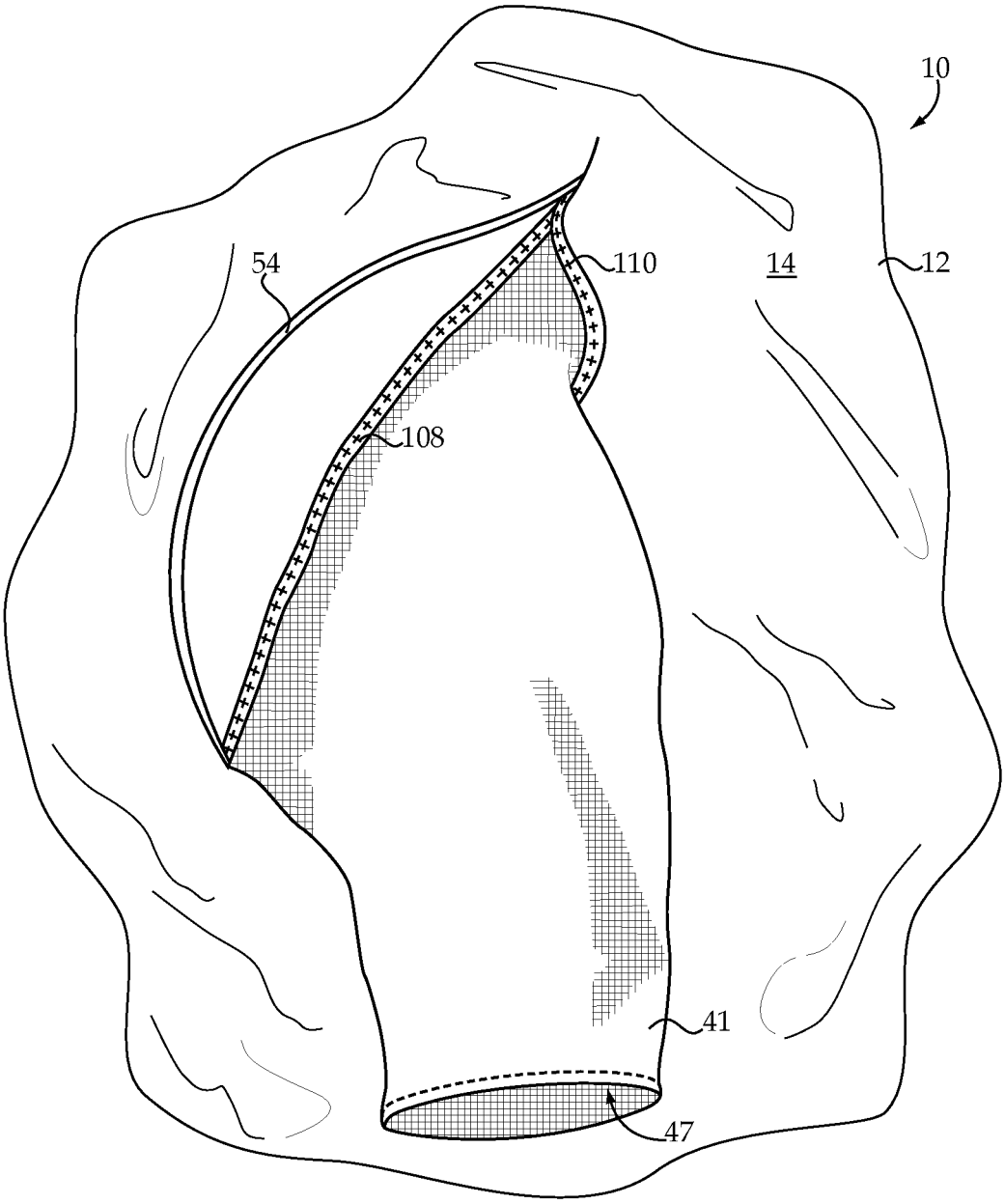
FIG. 5 is a diagrammatic view of a different portion of the sleeved styling cape.

Referring now also to FIGS. 4 and 5, there are shown additional features of styling cape 10. In the case of FIG. 4, an individual has passed their hands and wrists through sleeve 43. It can be seen that sleeve 43 retains some shape, i.e. rumpling, apart from conforming strictly to the shape of the individual's arm, but has generally stretched so as to provide a form fitting protective covering over the individual's arm and wrists that will prevent cut hair, other debris or styling products and the like from falling onto the individual's skin. It has been discovered that the use of elastic material for sleeves 41 and 43 is vastly more comfortable, and effective in turns of keeping the sleeve 41 and 43 in a configuration and position over the individual's skin that can provide the desired protection. Also shown in FIG. 4 is outer surface 14, in sufficient detail to illustrate surface texturing. Surface texturing 15 can included flattened, ironed or otherwise melt-formed features 15, or any other suitable permanent plastic deformation of the material of which sheet 12 is formed. Features 15, or any other features could also be applied as a secondary material in certain embodiments. It can be seen from FIG. 4 that flap 56 extends generally partially around the individual's arm. Flap 56 may have a relatively slicker surface texture than other parts of cape 10 in certain embodiments. In FIG. 5, there is shown sleeve 41 with flap 54 peeled back to illustrate stitching 108 and 110 that attaches sleeve 41 to sheet 12. As discussed above, a general shape of through-holes 38 and 40 is the form of a slit, so that stitching 108 and 110 will together generally form an oval shape with pointed ends. An opening 47 is shown in the free end of sleeve 41, so as to represent the conduit formed for passage of the individual's hand and wrist.

As noted above, a great many different styling cape designs have been proposed over the years. While sometimes the subject of criticism and even ridicule, the use of personal handheld electronic devices has become so pervasive in recent years that individuals generally wish to have access to their smart phones and other devices all the time, even when receiving a haircut or other styling procedure. For these reasons, a very real need and desire in the art for a purpose-built styling cape that readily enables such activities without breaking the cape's protective barrier exists, and the present disclosure answers these needs and desires. Earlier styling cape designs did not sufficiently facilitate use of personal handheld electronic devices in this manner, and individuals would typically reach into their pocket, pull out their phone, and then extend their arm out of the protective styling cape to position the device where they could see and use it. It can be readily understood that such activities in part defeat the purpose of the protective cape altogether, exposing the individual's skin and/or clothes, and even the device itself to the elements in a salon. According to the present disclosure, an individual will be able to manipulate his or her device and move his or her hands and wrists within some range of motion without substantially changing the position of sleeves 41 and 43 upon their arms and wrists. This is due at least in part to the structure and selected materials of the sleeves and other parts of styling cape 10, as described herein.

The present description is for illustrative purposes only, and should not be construed to narrower the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

The invention claimed is:

1. A styling cape comprising:

a flexible sheet formed at least in part of a first material and including an outer surface and an inner surface, and a plurality of outer peripheral edges including a front edge, a back edge opposite the front edge, and a first and a second side edge extending between the front and back edges so as to form a substantially rectangular shape when the flexible sheet is flat and unfolded in a spread-out configuration of the styling cape;

the back edge being bisected by a slit extending from the back edge to a curved inner peripheral edge forming an opening configured to be positioned about an individual's neck when the flexible sheet is configured such that the flexible sheet is draped over the individual in a use configuration of the styling cape;

a closure having a first closure element and a second closure element positioned upon opposite sides of the slit, respectively, for closing the slit to secure the styling cape when configured about the individual in the use configuration;

a first through-hole and a second through-hole formed in the flexible sheet, and positioned so as to form a triangular pattern in combination with the opening in each of the spread-out configuration and the use configuration; and a first sleeve and a second sleeve formed of a second material that is elastic in comparison to the first material and attached to the sheet so as to communicate with the first and second through-holes, respectively, and forming conduits with the first and second through-holes configured to allow passage of the individual's hands through the styling cape.

2. The styling cape of claim 1 wherein each of the first and second sleeves further has a taper so as to narrow in an outward direction away from the flexible sheet.

3. The styling cape of claim 2 wherein each of the sleeves has a sleeve length, and a non-uniform sleeve diameter that varies from a greater sleeve diameter at a first end of the sleeve adjacent the corresponding through-hole to a lesser sleeve diameter at an opposite second end of the sleeve, and wherein the sleeve length is not greater than three times the greater sleeve diameter, and not greater than four times the lesser sleeve diameter.

4. The styling cape of claim 2 further comprising a second flexible sheet attached to the first flexible sheet and surrounding the opening in layered arrangement with the first flexible sheet, and the second flexible sheet being formed of a third material so as to form a protective layer configured to extend over the shoulders of the individual in the use configuration.

5. The styling cape of claim 1 wherein the opening is closer to the back edge than to the front edge.

6. The styling cape of claim 5 wherein the opening has a center point, and a centerline of the slit intersects the center point of the opening in the spread-out configuration, and wherein a transverse line is oriented normal to the centerline and intersects the center point and each of the first and second side edges in the spread-out configuration.

7. The styling cape of claim 6 wherein each of the first and second through-holes has a center point, and the center points of the through holes define a second transverse line oriented parallel to the first transverse line, in the spread-out configuration, and positioned closer to the front edge than to the back edge.

8. The styling cape of claim 5 further comprising a first flap adjacent the first through-hole and first sleeve and a second flap adjacent the second through-hole and second sleeve, and each of the flaps being oriented so as to deflect cut hair falling under the force of gravity toward the first sleeve and the second sleeve, respectively.

9. The styling cape of claim 1 wherein each of the opening and the first and second through-holes has a center point, and the triangular pattern is defined by the center points.

10. A styling cape comprising:

a first flexible sheet that is substantially rectangular in shape having a plurality of outer peripheral edges including a primary front edge, a primary back edge, and a primary first and second side edge;

the first flexible sheet further having a top side and a bottom side, and a first opening defined as a circular cutout configured to fit around an individual's neck, the circular cutout forming a primary inner peripheral edge, a center point of which is equidistant from both the primary first and the primary second edge and is closer to the primary back edge than to the primary front edge;

the first flexible sheet having a primary slit extending from the primary inner peripheral edge to the primary back edge;

a second flexible sheet that is substantially rectangular in shape having a plurality of outer peripheral edges including a secondary front edge, a secondary back edge, and a secondary first and second side edge second;

the second flexible sheet further having a second opening defined as a circular cutout forming a secondary inner peripheral edge having substantially the same dimensions as the first opening;

the second flexible sheet having a secondary slit extending from the secondary inner peripheral edge to the secondary back edge;

the second flexible sheet affixed to the top side of the first flexible sheet and configured so that the primary inner peripheral edge and the secondary peripheral edge are aligned and the primary slit is aligned with the secondary slit, with the primary front edge parallel to the secondary front edge, the primary back edge parallel to the secondary back edge, and the primary first and second side edges parallel to the secondary first and second side edges, respectively, when the cape is in a spread-out configuration;

the first flexible sheet having a first and a second through-hole each positioned closer to the primary front edge than the primary back edge when the cape is in a spread-out configuration;

a first sleeve and a second sleeve each having a proximal opening and a distal opening, with the proximal opening of the first sleeve affixed to the first flexible sheet so as to communicate with the first through-hole and proximal opening of the second sleeve affixed to the first flexible sheet so as to communicate with the second through-hole;

the first sleeve and the second sleeves having a wider circumference at the proximate opening than the distal opening; and a first flap and a second flap being located adjacent to the distal opening of the first sleeve and the second sleeve, respectively.

* * * * *